United States Patent [19]

Stapleton et al.

[11] 4,162,868

[45] Jul. 31, 1979

[54] INVALID FEEDING DEVICE

[76] Inventors: Patrick Stapleton, 1738 Colquitt; Hubbard P. Browne, 1627 Colquitt, both of Houston, Tex. 77098; Dallas D. Weatherholt, 13207 Buxley, Houston, Tex. 77045

[21] Appl. No.: 862,655

[22] Filed: Dec. 20, 1977

[51] Int. Cl.[2] ..... A47G 21/08

[52] U.S. Cl. ..... 414/9; 119/51.13; 119/56 R; 128/222; 222/636

[58] Field of Search ..... 214/1 T, 1 CM; 128/222, 128/223; 222/194, 361, 362; 119/51.11, 51.13, 56 R

[56] References Cited

U.S. PATENT DOCUMENTS

| | | | |
|---|---|---|---|
| 2,772,659 | 12/1956 | Tennis | 119/51.11 X |
| 3,185,190 | 5/1965 | Crawford | 222/361 X |
| 3,317,061 | 5/1967 | Causey | 214/1 T |
| 3,340,851 | 9/1967 | Frank et al. | 119/56 R X |
| 3,797,709 | 3/1974 | Ivanovich | 222/194 |
| 3,907,126 | 9/1975 | Sydnor | 214/1 T |
| 4,000,719 | 1/1977 | Richards | 119/51.13 |

*Primary Examiner*—L. J. Paperner
*Attorney, Agent, or Firm*—Ranseler O. Wyatt

[57] ABSTRACT

An invalid feeding device for persons unable to feed themselves in the usual manner, having a selective means for transporting food from containers to the mouth of the person being fed, the transporting means being controlled and having self contained means for reversing the movement of the transport, and for disengaging the same upon completion of each cycle.

1 Claim, 3 Drawing Figures

INVALID FEEDING DEVICE

BACKGROUND OF THE INVENTION

Invalid feeding mechanisms as presently known to the industry are cumbersome and complicated mechanisms, expensive to the user, and difficult to maintain and to clean. It is an object of this invention to provide a portable mechanism that can be easily operated by the person to be fed, and that can be easily maintained and will be relatively inexpensive to manufacture.

SUMMARY OF THE INVENTION

An invalid feeding device having means for selectively transporting food from a container to the person being fed, said transporting means being movable in cycles, terminating said movement at the completion of each cycle and having means for moving food from said containers to said transporting means under pressure.

DESCRIPTION OF THE PREFERRED EMBODIMENT

Figure 1:
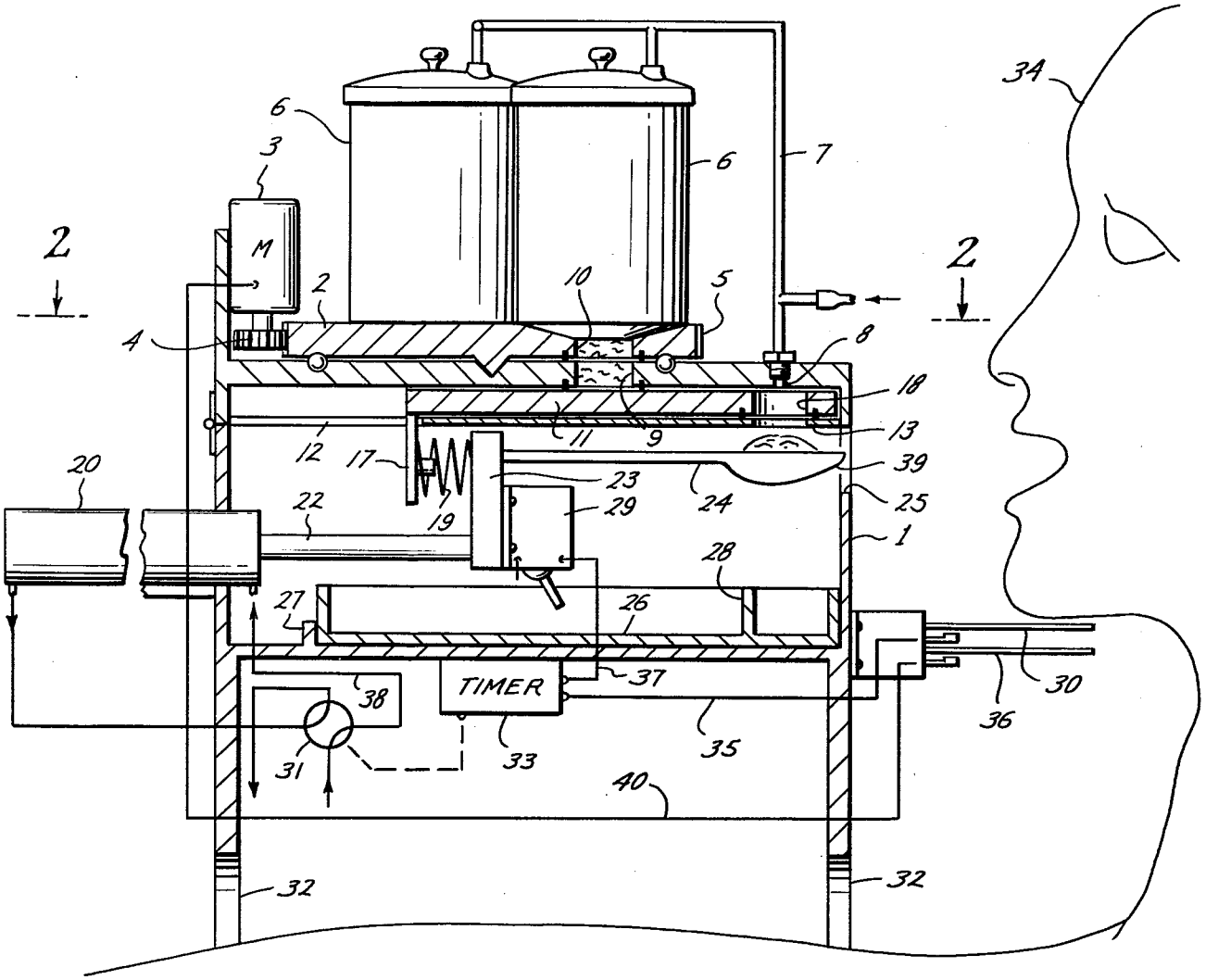
FIG. 1 is a side elevational, cross sectional, view of the device.
Figure 2:
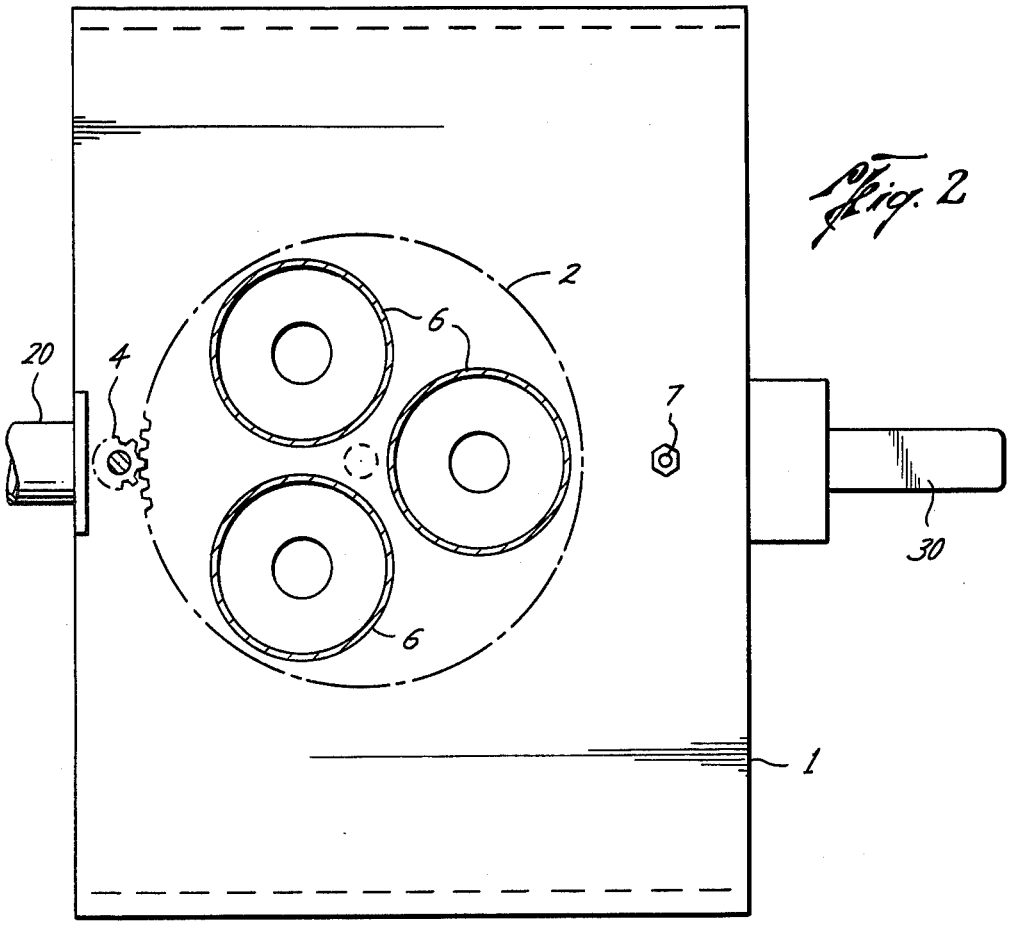
FIG. 2 is a top plan view, taken on the line 2—2 of FIG. 1.

In the drawings, the numeral 1 designates a housing of stainless steel, or the like, upon which is rotatably mounted the turn-table 2, rotated by the motor 3 and gear 4, said gear 4 meshing with the peripheral gear 5 on the turn table 3. Food containers 6, 6 are mounted on the turn table 3, with a flexible conduit as 7 extending into the top there of, and into a port in the housing 1, as 8, and a port 9 in the top of the housing 1 provides passageway therethrough for food from the containers 6, which passes through the ports 10 in the turntable, when brought into alignment with the port 9.

A reciprocable table 11 is mounted in the housing 1 immediately beneath the top wall of said housing 1, riding on the tracks 12 and over the fixed table 13. Seals, such as o-rings 14, 15, 16, confine the food passage to the respective ports, including the port 18 in the table 11. A downwardly extended arm 17 projects from the table 11, and a spring 19 is mounted on said projecting arm 17.

A hydraulic cylinder 20 is mounted in the housing 1, and extends rearwardly therefrom. A piston 21 is reciprocably mounted in said cylinder, and has the shaft 22 extending therefrom. An upwardly projecting arm 23 is mounted on the extended end of said piston shaft 22 and the transporting means 24 is mounted on the upper end of said arm 23, and moves into and out of the housing 1 through the port 25. A spill tray 26 is seated in the bottom of the housing 1, and maintained in position by the stop member 27. The tray 26 has an upwardly extending wall 28 adjacent one peripheral margin. Switches 29, 30 control the flow of hydraulic fluid through the valve 31, and cylinder 20.

Figure 3:
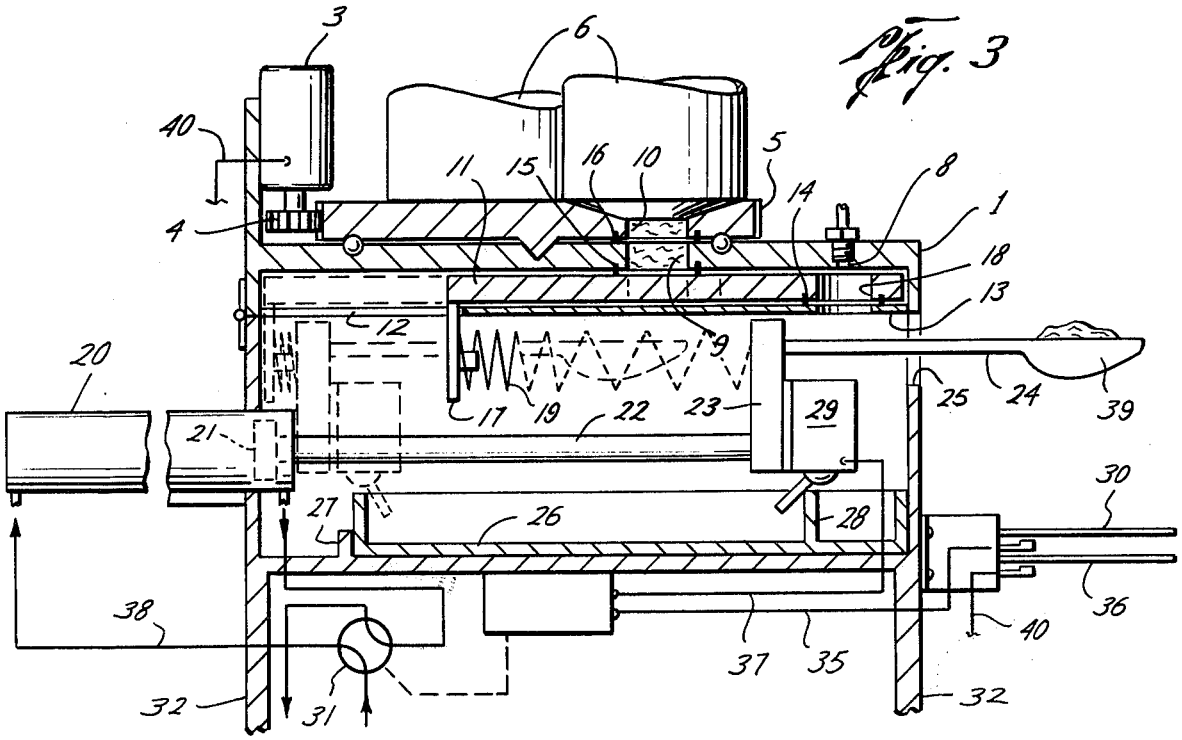
FIG. 3 is a side elevational view, in cross section, illustrating the position of the transporting means when in fully extended position.

Hot food is placed in the containers 6, and the device set over the person to be fed, the legs 32, 32 supporting the housing 1. One of the switches, as 30, is actuated by the chin of the invalid 34, which sends a circuit through the line 35 into the timer, and from the timer 33, through the line 37, moving the valve 31 to provide a flow of hydraulic fluid through line 38, starting the cycle of the transport, the piston 21 moving the shaft 22 outwardly against the arm 17, and moving the table 11 rearwardly to the position shown in dotted lines in FIG. 3, whereupon the port 18 will be in alignment with the port 9, and the slight pressure maintained on the container through the line 7 will move a charge of food downwardly into the port 18. The movement of the arm 23 rearwardly brings the transport 24 rearwardly, and the switch 29 will be tripped by contact with the marginal wall of the spill tray 26, reversing the flow of hydraulic fluid through the cylinder 20, by means of the current flow through line to the timer 33, and thence through the line 37. Upon reversing the flow of hydraulic fluid in the cylinder 20, the shaft 22, and transport 24 will move forwardly by the spring 19, until the table 11 reaches its maximum forward movement, at which point the spoon 39 of the transport 24 will be in alignment with the port 18, and the pressure from the line 7 will move the food into the spoon 39, and the transport will continue its forward movement until the switch 29 is tripped by the wall 28. The transport will remain in extended position, where the patient may take the food from the spoon 39, until the timer 33 again reverses the flow of hydraulic fluid, and the cycle is completed when the transport returns to the position shown in FIG. 1, and to repeat the cycle, the switch 30 must be again actuated. If the invalid requires food from a different container, the invalid actuates the switch 36, which sends a current to the motor 3 through line 40, which will rotate the turntable 3. When the desired container is aligned with the port 9, the switch is released and the rotation of the turntable ceases.

What we claim is:

1. In an invalid feeding device, a housing, a food container table on said housing, a port extending therethrough, food transport means reciprocally mounted in said housing, a movable table mounted in said housing between the upper wall thereof and said transport, a port in said table, means for moving said table into alignment with said port in said food container table and in sequence into alignment with said food transport, means for moving said food transport out of said housing into invalid feeding position, a removable spill tray anchored in said housing, a switch carried by said transport which moves against said spill tray at the end of each stroke to actuate said switch and reverse the movement of said transport.

* * * * *